United States Patent [19]

Campbell

[11] Patent Number: 4,856,436

[45] Date of Patent: Aug. 15, 1989

[54] AUTOMATICALLY EXPANDING PROTECTIVE COVER

[76] Inventor: Jonathan Campbell, 5721 Zelzah Ave., Encino, Calif. 91316

[21] Appl. No.: 148,347

[22] Filed: Jan. 25, 1988

[51] Int. Cl.[4] ..... E06B 9/00

[52] U.S. Cl. ..... 109/1 R; 109/49.5; 109/38; 150/165; 206/45.34; 160/299; 312/208; 312/229

[58] Field of Search ..... 109/1 R, 1 S, 24, 38, 109/49.5, 52; 160/299; 150/52 R; 312/100–102, 229, 208; 206/1 R, 45.34

[56] References Cited

U.S. PATENT DOCUMENTS

| | | | |
|---|---|---|---|
| 1,410,529 | 3/1922 | Harrold | 72 X/ |
| 1,420,443 | 6/1922 | Owen | 160/72 X |
| 1,534,664 | 4/1925 | Saunders | 160/72 X |
| 1,849,255 | 3/1932 | Starr | 160/72 |
| 1,988,666 | 1/1935 | Sandell | 160/72 |
| 2,008,412 | 7/1935 | Bovee et al. | 150/52 R |
| 2,276,550 | 3/1942 | Skyum | 160/72 |
| 2,326,713 | 8/1943 | Wesseler | 109/49.5 X |
| 2,492,262 | 12/1949 | Boyden et al. | 150/52 R |
| 3,022,808 | 2/1962 | Silver | 150/152 R |
| 3,259,173 | 7/1966 | Manning | 150/52 R X |
| 3,454,075 | 7/1969 | Weinstein | 150/52 R |
| 3,645,594 | 2/1972 | Cintz | 312/100 |
| 3,863,694 | 2/1975 | Fisher | 150/52 R X |
| 4,059,059 | 11/1977 | Hughes | 109/1 R |
| 4,530,389 | 7/1985 | Quinn et al. | 160/299 X |
| 4,632,329 | 12/1986 | Burley | 150/52 R |

FOREIGN PATENT DOCUMENTS

| | | | |
|---|---|---|---|
| 328493 | 8/1935 | Italy | 150/52 R |
| 8700950 | 2/1987 | World Int. Prop. O. | 109/38 |

*Primary Examiner*—Gary L. Smith
*Assistant Examiner*—Suzanne L. Dino
*Attorney, Agent, or Firm*—Albert O. Cota

[57] ABSTRACT

A protective cover for electronic equipment automatically expanding by the spring action of a pair of telescoping arms (24) having a cover (48) of resilient material attached between. The arms (24) are positioned contiguous with a pair of bases (20) that are located parallel with each other on the floor on either side of the electronic equipment with a hinged cover enclosure (50) between the ends forming a "U" shape. The arms (24) are connected on the ends by a strut (26) holding the cover (48). Solenoids (58) retain the arms in a tensioned position and when electrically actuated release them. The spring action pivots the arms with its accompanying cover completely enveloping the equipment. A lever (64) arrangement overrides the solenoid action manually releasing the arms. The device is reset by manually rotating and compressing the arms while folding the cover (48) into the enclosure (50). The object is to protect expensive equipment from fire, smoke and water damage if a fire is in the vicinity.

8 Claims, 3 Drawing Sheets

AUTOMATICALLY EXPANDING PROTECTIVE COVER

TECHNICAL FIELD

The present invention relates to protective covers in general, more particularly to covers for electronic equipment that automatically expand from a folded position to a completely encompassing position by manual release or electrical energization.

BACKGROUND ART

Previously, many types of covers have been used in endeavoring to provide an effective means of protecting a wide variety of equipment by using some type of enclosure. In known instances the covers are manually hinged, rolled, or folded over the articles, however, nowhere was found an automatic system that included the ability to quickly enclose the article by self-contained electrical and mechanical means.

A search of the prior art did not disclose any patents that read directly on the claims of the instant invention, however, the following U. S. patents were considered related:

| Patent No. | Inventor | Issue Date |
|---|---|---|
| 3,645,594 | Cintz | Feb, 29, 1972 |
| 3,454,075 | Weinstein | Jul. 8, 1966 |
| 3,259,173 | Manning | Jul. 5, 1966 |
| 746,675 | Childress | Dec. 15, 1903 |

Cintz teaches a box-like transparent rigid, plastic enclosure for a printer on an outdoor cash stand at a service station. The enclosure has a removable end wall, or is pivotally attached. The size of the enclosure allows operation of the equipment inside without removing it from the stand.

Weinstein discloses a cover for office machines, such as typewriters, that includes a rigid bracket frame extending at the back and under the equipment. A cover is rolled, in window blind fashion, around a shaft extending between uprights of the bracket. The cover is unrolled from the shaft which contains window blind type springs and has no sides, but shelters the top of the equipment when unrolled and is held in place by a weighted slat.

Manning also covers an office machine, such as a typewriter, etc. The function is much like the above, except the cover is enclosed in a retractable device directly behind the machine. The retractable device keeps the cover clean and free from eraser dust and is manually operated by pulling the rolled cover from a slot in the device. Again, no sides are incorporated into the protective cover.

Childress employs a folding structure that supports a flexible cover keeping it in a smooth and unwrinkled condition when extended and yet folds into a compact space for storage. The operation of this cover is completely manual and is placed over the typewriter, or similar device, after is expanded.

DISCLOSURE OF THE INVENTION

Since the advent and production of expensive electronic equipment, such as computers, in relatively large quantities, a potential problem has arisen in that if a fire were to break out within the room housing this equipment, water is used by the automatic sprinkler system or firefighters creating a potentially hazardous situation for the equipment. Computer and peripheral components, such as mainframes, disk drives, tape drives, printers, card readers, and the like, are very sensitive to water damage, particularly a deluge of water caused by firefighting gear, and may be easily damaged or completely destroyed. Presently, there is no protection at all for these expensive devices if even a small fire were to be present, insufficient time is available to cover the equipment, preventing this type of loss.

It is, therefore, the primary object of the invention to automatically cover the electronic equipment at the same time the alarm is engaged. This is accomplished by having the cover folded and stored on the floor either in front or at the rear of the equipment, and when the alarm is actuated, an electrical circuit disengages a spring loaded structure, pulling the cover completely over the equipment. In the event the alarm system is inoperative and time is available, the electrical actuating device may be manually overridden by pulling a lever on either side, releasing the cover to expand by the tension of springs employed within the structure. Once the cover is in place, the water resistant characteristic of the material provides the needed protection eliminating completely the potential of water damage and also provides limited protection from fire and smoke damage.

An important object is the speed at which the cover may be expanded. Since energy must be stored within the springs in a purely mechanical manner, the release, expansion and unfolding is completely controlled and the time is sufficiently quick to accomplish this protection.

Another object of the invention is the compactness of the package when it is preset on the floor. The entire invention is folded into a small area just slightly longer than half of the width of the equipment and its full width. The height above the floor is minimal and it is protected such that it may be stepped on without damage.

Still another object of the invention is the ease at which it may be manually reset if a false alarm is given. The arms are simply rotated against the spring pressure and compressed into themselves when in the loaded position and the cover is folded into the receptacle and the solenoid armatures lock the arms into place by simply depressing them against spring pressure.

Yet another object of the invention is its simplicity and ease of operation. As such, no elaborate instructions are necessary, as the electrical energization is completely automatic and the manual operation is obvious by its basic appearance.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
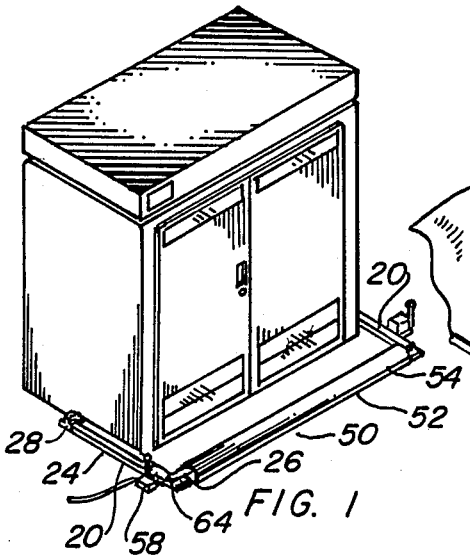
FIG. 1 is a partial isometric view of the preferred embodiment installed on the floor adjacent to the electronic equipment in the form of a computer mainframe.
Figure 2:
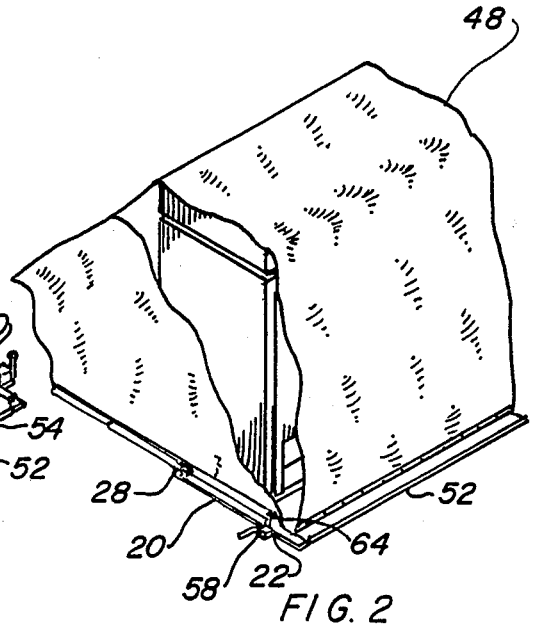
FIG. 2 is a partial isometric view of the preferred embodiment as above, with the cover expanded in the energized position. The cover is partially cut-away to expose elements thereunder.
Figure 3:
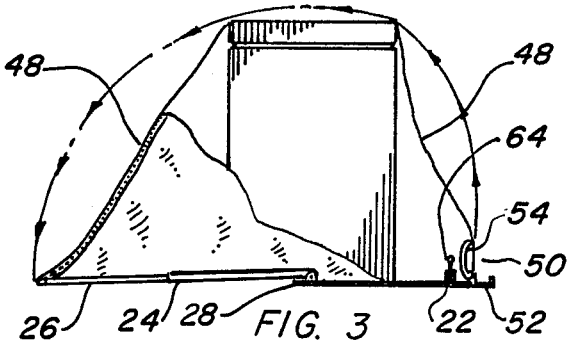
FIG. 3 is a side view of the preferred embodiment shown partially cut-away for clarity.
Figure 4:
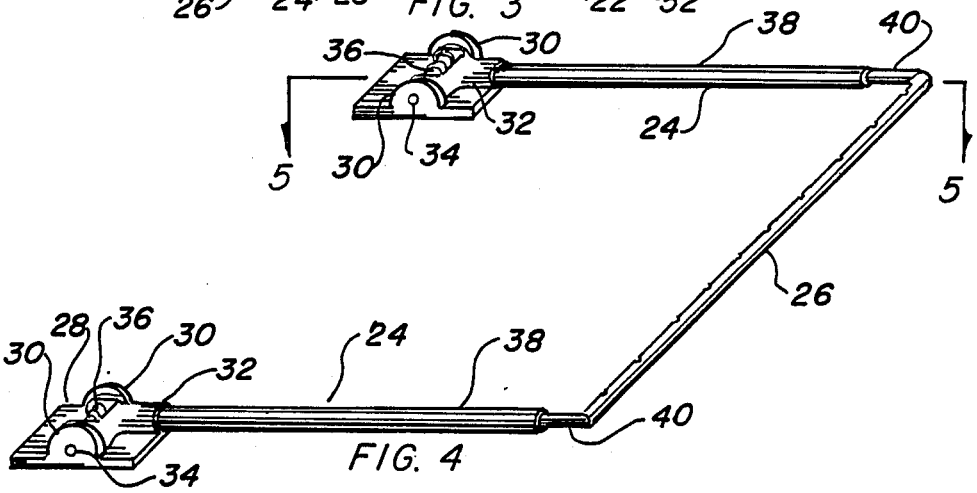
FIG. 4 is a partial isometric view of the arms completely removed from the invention for clarity.
Figure 5:
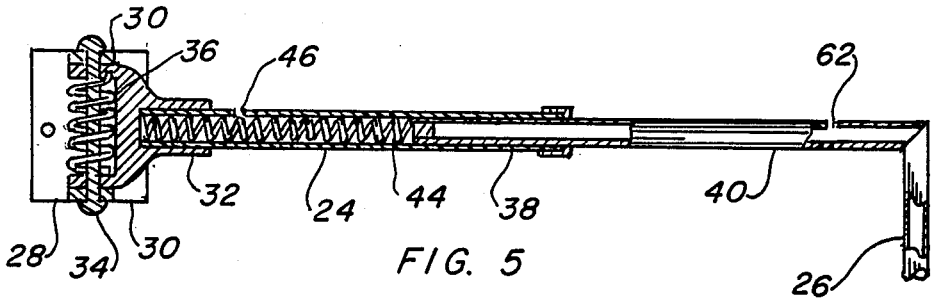
FIG. 5 is a cross-sectional view taken along lines 5—5 of FIG. 4.
Figure 6:
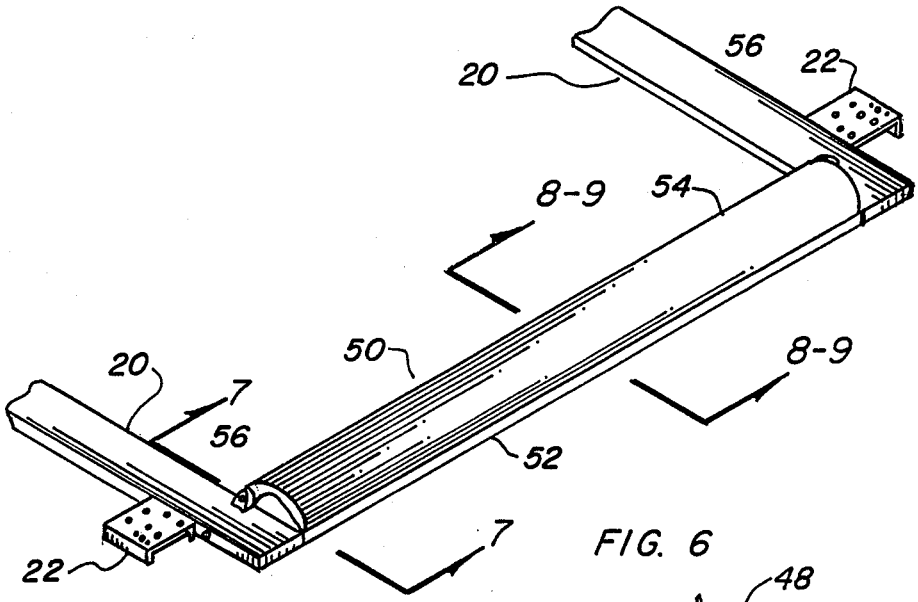
FIG. 6 is a partial isometric view of the floor bases, only without any other elements.
Figure 7:
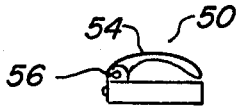
FIG. 7 is a cross-sectional view taken along lines 7—7 of FIG. 6.
Figure 8:
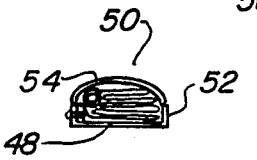
FIG. 8 is a cross-sectional view taken along lines 8—8 of FIG. 6 in the retracted position.
Figure 12:
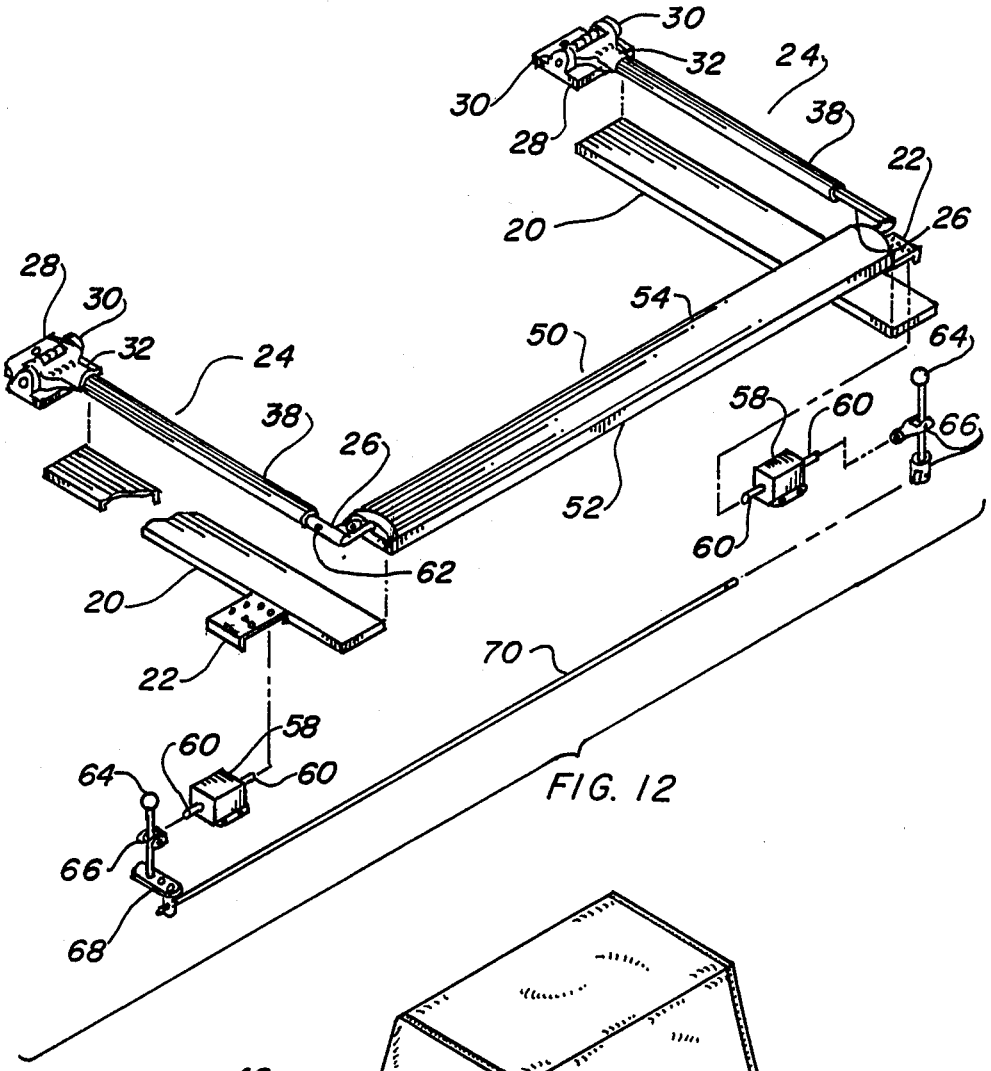
FIG. 12 is an exploded view of the invention with the cover folded and retracted.
Figure 13:
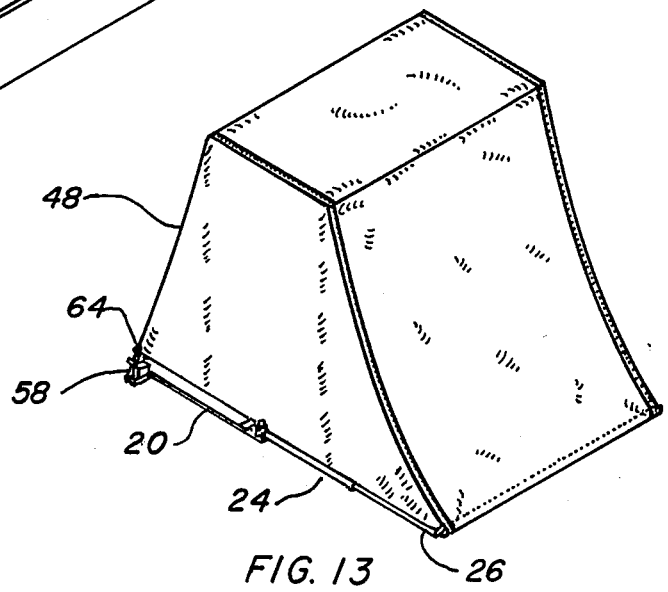
FIG. 13 is a partial isometric view of the preferred embodiment in its actuated position taken from the side opposite FIG. 2.

The best mode for carrying out the invention is presented in terms of a preferred embodiment. The preferred embodiment, as shown in FIGS. 1 through 13 is comprised of a pair of floor bases 20 that are positioned in close proximity to electronic equipment that the invention is protecting. The bases 20 are located on the floor parallel to the sides of the equipment starting at the center and extending just beyond the front or rear surface. Each base 20 is rectangular in shape and either solid or in the form of an inverted channel, as shown in FIG. 12. On a side opposite the equipment and at the extending end, a mounting bracket 22 is attached. This bracket 22 forms mounting means for the operating mechanism and manual escapement elements. The bracket 22 is preferably formed in channel shape, illustrated in FIG. 6, and is much like the base 20, also being parallel thereunto. On the opposite end of the base 20 are attachment means for other components making up the invention.

A pair of pivotal spring loaded extending arms 24 with a connecting strut 26 in "U" shape are mounted contiguously with the bases 20 forming an extension 28 thereof on each end. The pivoting end of the arm 24 is butted such that the base is extended and a pair of upstanding legs 30 protrude from opposite edges. Between the legs 30 is a yoke 32 that pivots on a pin 34, best depicted in cross-sectional view FIG. 5. A torsional spring 36 is disposed over the pin 34 and is attached on one end to the arm extension 28 and to the yoke 32 on the other. This spring 36 creates a rotational force moving the arm 24 axially into an expanded position away from the base 20 and creating rotational thrust when pivoted contiguously with the base 20. The arm 24, depicted best in FIGS. 4 and 5, consists of a pair of first hollow tubular members 38 attached to each yoke 32 on one end and a pair of second tubular members 40 attached to the strut 26 forming the "U" shape of the arm 24. Each second tubular member 40 is contained within the first tubular member 38 and a compression spring 44 is positioned therebetween. The arms 24 and connecting strut 26 rotate in unison from one side of the equipment to the other by the influence of the torsional spring 36. The second tubular members 40 along with the strut 26 extend, when released, by the urging of the compression spring 44 increasing in length to clear the height of the equipment in which the invention protects. The arm 24 and strut 26, in the open position, are held firmly against the floor and extended fully from the first and second tubular member 38 and 40. In the closed position the arms 24 are rotated 180 degrees to the opposite side, therefore, resisting the spring tension. Also, the tubular members 34 and 40 are retracted into each other and resist compression of the spring 44. The speed at which the tubular members 38 and 40 expand when released is governed by either the closeness of the fit between the members or an orifice 46, shown in FIG. 5, may be added in the first member 38 through which air may pass when the spring 44 urges the members 38 and 40 apart.

A cover 48 of resilient material is attached to the connecting strut 26 on one side and is in a rectangular box shape with one side open. The open side is downward against the floor and the shape is such that it covers the electronic equipment when the connecting strut 26 is in the rotated position at the rear of the equipment. The cover 48 has the ability to be folded into a series of pleats when the arms 24 are in the loaded position and the strut 26 is contiguous with the bases 20. The cover 48 may be of a thermoplastic substance having flame retarding characteristics and water resistance or may be a woven cloth material stitched together with thread with one or both of the protective abilities.

Figure 9:
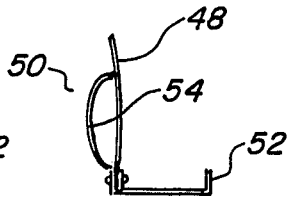
FIG. 9 is a cross-sectional view taken along lines 9—9 of FIG. 6 in the open or energized position.
Figure 10:
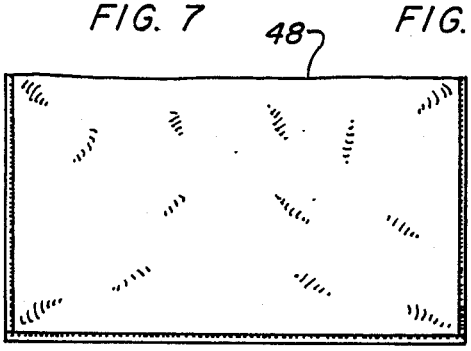
FIG. 10 is a front view of the cover, only in its expanded position.
Figure 11:
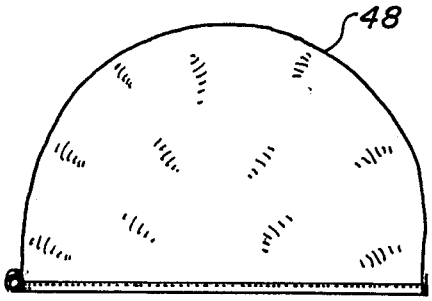
FIG. 11 is a front view of the cover, only in its side position.

A hinged cover enclosure 50 is positioned between the arms 24 and floor bases 20 and is parallel to and of the same approximate length as the strut 26. The enclosure 50 consists of a bottom tray 52 and a pivoted spring loaded lid 54 connected on each side to the tray. The enclosure 50 is of a size to accept and store the folded cover 48 and is pivoted in such a manner as to open the lid 54 when the cover 48 is automatically expanded. The enclosure 50 is shown pictorially in FIG. 6 with FIGS. 7 and 8 in cross-section with FIG. 9 illustrating the open position. A spring 56 is located at the pivot point on each intersection of the tray 52 and operates in the same manner as the torsion spring 36. The tray 52 and lid 54 may be fabricated of any substance suitable for the application, however, steel or aluminum are preferred.

Electrically actuated containment and escapement means to control the operation of the invention consist of a pair of electromagnetic solenoids 58 having a spring loaded double extending armature 60. Each solenoid 58 is attached to one of the floor bases 20 on the mounting bracket 22 providing a location adjacent to the arms 24. The spring loading of the armature 60 extends one end horizontally to interface with a hole 62 in each arm 24. When the arm 24 is rotated contiguously with the base 20 the armature 60 extends into the hole 62 locking the arm in the preloaded pivoted position. Upon electrical energization of the solenoid 58, the armature 60 is retracted pulling the end of the armature 60 from contact with the arm 24 allowing the arm 24, along with its attached cover 48 to pivot over the top of the electronic equipment, thus covering the entire surface in an automatic and expandable manner.

Manual containment and escapement means integral with the above electrical actuated means allow mechanical override of the system. This is accomplished with a pair of levers 64, one mechanically linked onto each extending arm 24 through the solenoid armature 60. This arrangement allows either lever to be manually pulled releasing the arm 24 from its contained position in the same manner as above. The levers 64 are pivotally connected to the armatures 60 above the midpoint of the lever and linear movement of the lever produces resistance against the spring loading of the armature releasing the arms 24 and returning to the locked position upon release under the urging of the spring. Rotating joints 66 are connected moveably on one end of the levers 64 to a midpoint on one end and to the base bracket 22 on the other. This arrangement allows the lever 64 to pivot either pulling or pushing the armature 60 in a linear direction.

A swivel arm 68 is attached to one of the mounting brackets 22 in the middle in a rotatable manner. One end of the swivel arm 68 is attached to the adjacent lever 64. When the lever 64 is moved, the opposite end of the swivel arm 68 is rotated in the opposite direction. A connecting arm 70 is joined on one end to the swivel arm 68 and to the remaining lever 64 on the other. The connection of the connecting arm 70 to the second lever 64 is at a position lower than midpoint defining an interconnection between levers 64. This association allows either lever 64 to be manually pulled away from the solenoid 58 disengaging both armatures 60 simultaneously from the mechanical locking position for either release or escapement, also containment when resetting the arms 24. Either solenoid 58 may be overridden in both modes of operation and acts as a single operating station.

In operation the invention is positioned on the floor either in front of or behind the electronic equipment. In the event of a fire, the solenoids 58 are electrically energized disengaging the arms 24 from their spring loaded position. When released, the arms 24 extend and rotate simultaneously pulling the cover 48 over the top of the equipment, creating a watertight cover, preventing water damage from firefighting equipment and limited protection from fire and smoke. The direction of travel is pictorially illustrated in FIG. 3 by arrows and the extension of the arm 24 is coordinated to be completely extended by the time the strut 26 clears the edge of the electronic equipment cabinet. Electrical operation may be overridden by mechanical means pulling one of the levers 64 away from the device.

To reset the protective cover, the arms 24 are rotated back over the electronic gear and retracted into themselves while the cover 48 is folded in pleats into the enclosure 50 with the solenoids 58 holding the arms in place by the detent action of the armatures 60 into the appropriate holes 62.

While the invention has been described in complete detail and pictorially shown in the accompanying drawings, it is not to be limited to such details, since many changes and modifications may be in the invention without departing from the spirit and the scope thereof. For example, the cover 48 may be fabricated of a thin flexible metal and pleats may be included to prevent smoke from seeping into the cover. Hence, it is described to cover any and all modifications and forms which may come within the language and scope of the appended claims.

I claim:

1. An automatically expandable protective cover for electronic equipment comprising:

(a) a pair of floor bases disposed in close proximity to the electronic equipment parallel with two of the equipment sides distending from the center thereof to at least beyond the equipments front surface;

(b) a pair of pivotal spring loaded extending arms with a connecting strut in between forming a "U" shape, having the pivoted end mounted on said bases at the center of the equipment for rotation from one side of the equipment to the other under the influence of the pivoted spring, said arms further having compression springs integrally affixed therein, with the extension providing the increase in length to clear the electronic equipment when rotating thereover;

(c) a cover of resilient material having sides, a front, a rear, and a top, with said rear attached to said connecting strut and said front disposed between said floor bases on the ends opposite the center defining a protective enclosure for the electronic equipment, said cover of a size to completely envelope the equipment when said connecting strut is extended on the rear and the front of the cover opposed between the bases, having the ability to fold into a series of pleats when the arms are rotated in the spring loaded position with the strut contiguous with the base distended ends;

(d) electrically actuated containment and escapement means interfacing with said arms such that the arms are mechanically locked into place when rotated in the retracted and spring loaded position, and are released when electrically actuated by an electrical circuit thus allowing the cover to be folded and stored in a retracted position and completely extended, thereby enclosing the electronic equipment upon energization of the electric circuit of the containment and escapement means; and, (e) manual containment and escapement means integral with the electrically actuated means having a pair of levers one mechanically linked onto each extending arm such that either lever may be manually moved releasing the arm from its contained position allowing the arm to pivotally rotate under spring influence enclosing the electronic equipment with said cover.

2. The protective cover as recited in claim 1 wherein said floor bases further comprise, means to attach said extending arms on one end and mounting means to connect said electrically actuated containment and escapement means on the other, said mounting means spaced above said floor bases such that a portion of the manual containment and escapement means may be housed thereunder.

3. An automatically expandable protective cover for electronic equipment comprising:

(a) a pair of floor bases disposed in close proximity to the electronic equipment parallel with two of the equipments sides distending from the center thereof to at least beyond the equipments front surface;

(b) a pair of pivotal spring loaded extending arm with a connecting strut in between forming a "U" shape, having the pivoted ends mounted on said bases at the center of the equipment for rotation from one side of the equipment to the other under the influence of the pivoted spring, said arms further having compression springs integrally affixed therein, with the extension providing the increase in length to clear the electronic equipment when rotating thereover;

(c) a cover of resilient material having sides, a front, a rear, and a top with said rear attached to said connecting strut and said front disposed between said floor bases on the ends opposite the center defining a protective enclosure for the electronic equipment, said cover of a size to completely envelope the equipment when said connecting strut is extended on the rear and the front of the cover opposed between the bases, having the ability to fold into a series of pleats when the arms are rotated in the spring loaded position with the strut contiguous with the base distended ends;

(d) electrically actuated containment and escapement means interfacing with said arms such that the arms are mechanically locked into place when rotated in the retracted and spring loaded position, and are released when electrically actuated by an electrical circuit thus allowing the cover to be folded and stored in a retracted position and completely extended, thereby enclosing the electronic equipment upon energization of the electric circuit of the containment and escapement means;

(e) manual containment and escapement means integral with the electrically actuated means having a pair of levers one mechanically linked onto each extending arm such that either lever may be manually moved releasing the arm from its contained position allowing the arm to pivotally rotate under spring influence enclosing the electronic equipment with said cover, and (f) a hinged cover enclosure positioned between said extending arms having a bottom tray and a spring loaded pivotal lid connected rotatably onto one end of the tray, said enclosure of a size to accept and store said cover when folded into pleats along with said strut and pivoted in such a manner as to open the lid when the cover is automatically expanded.

4. An automatically expandable protective cover for electronic equipment comprising:

(a) a pair of floor bases disposed in close proximity to the electronic equipment parallel with two of the equipments sides distending from the center thereof to at least beyond the equipments front surface, (b) a pair of pivotal spring loaded extending arms with a connecting strut in between forming a "U" shape, having the pivoted ends mounted on said bases at the center of the equipment for rotation from one side of the equipment to the other under the influence of the pivoted spring, said arms further having compression springs integrally affixed therein, with the extension providing the increase in length to clear the electronic equipment when rotating thereover, said extending arms further comprise, a first hollow tubular member with a yoke on one end and a second tubular member contained within said first member, on the other end having a compression spring therebetween said second member contiguous with said spring on one end and attached to said strut on the other, thus forming the "U" shape of said arms, the yoke on each first member further having a torsional spring encompassing a pivot pin creating the rotational force moving the arm axially with the compression spring in each arm providing the linear expandable force to transport said cover from a folded position on one side of the electronic equipment to a completely encompassing position on the other when the spring is relaxed, (c) a cover of resilient material having sides, a front a rear, and a top, with said rear attached to said connecting strut and said front disposed between said floor bases on the ends opposite the center defining a protective enclosure for the electronic equipment, said cover of a size to completely envelope the equipment when said connecting strut is extended on the rear and the front of the cover opposed between the bases, having the ability to fold into a series of pleats when the arms are rotated in the spring loaded position with the strut contiguous with the base distended ends;

(d) electrically actuated containment and escapement means interfacing with said arms such that the arms are mechanically locked into place when rotated in the retracted and spring loaded position, and are released when electrically actuated by an electrical circuit thus allowing the cover to be folded and stored in a retracted position and completely extended, thereby enclosing the electronic equipment upon energization of the electric circuit of the containment and escapement means, and (e) manual containment and escapement means integral with the electrically actuated means having a pair of levers one mechanically linked onto each extending arm such that either lever may be manually moved releasing the arm from its contained position allowing the arm to pivotally rotate under spring influence enclosing the electronic equipment with said cover.

5. The protective cover as recited in claim 1 wherein said cover of resilient material further comprises, a thermoplastic substance having the characteristics of retarding the spread of flames when exposed thereunto.

6. The protective cover as recited in claim 1 wherein said cover of resilient material further comprises, a woven cloth substance formed in pieces having thread defining a stitched joint further having the characteristics of retarding the spread of flames when exposed thereunto.

7. An automatically expandable protective cover for electronic equipment comprising:

(a) a pair of floor bases disposed in close proximity to the electronic equipment parallel with two of the equipments sides distending from the center thereof to at least beyond the equipments front surface;

(b) a pair of pivotal spring loaded extending arms with a connecting strut in between forming a "U" shape, having the pivoted ends mounted on said bases at the center of the equipment for rotation from one side of the equipment to the other under the influence of the pivoted spring, said arms further having compression springs integrally affixed therein, with the extension providing the increase in length to clear the electronic equipment when rotating thereover;

(c) a cover of resilient material having sides, a front, a rear, and a top with said rear attached to said connecting strut and said front disposed between said floor bases on the ends opposite the center defining a protective enclosure for the electronic equipment, said cover of a size to completely envelope the equipment when said connecting strut is extended on the rear and the front of the cover opposed between the bases, having the ability to fold into a series of pleats when the arms are rotated in the spring loaded position with the strut contiguous with the base distended ends;

(d) electrically actuated containment and escapement means interfacing with said arms such that the arms are mechanically locked into place when rotated in the retracted and spring loaded position, and are released when electrically actuated by an electrical circuit thus allowing the cover to be folded and stored in a retracted position and completely extended, thereby enclosing the electronic equipment upon energization of the electric circuit of the containment and escapement means; said electrically actuated containment and escapement means further comprises, a pair of electromagnetic solenoids, each having a spring loaded double extended armature, each solenoid is attached to one of the bases and is positioned adjacent to said arms with the spring loading of the first end of the extended armature allowing the armature to mechanically lock into the arm and hold the arm in the pivoted position under the urging of the spring, upon electrical energization the solenoid creates an electromagnetic field pulling the first end of the armature from contact with said arm allowing the arm along with said cover to pivot over the top of the electronic equipment in an automatically expandable manner; and (e) manual containment and escapement means integral with the electrically actuated means having a pair of levers one mechanically linked onto each extending arm such that either lever may be manually moved releasing the arm from its contained position allowing the arm to pivotally rotate under spring influence enclosing the electronic equipment with said cover.

8. The protective cover as recited in claim 7 wherein said manual containment and escapement means further comprise:

(a) a pair of levers each pivotally connected to an armature of said solenoid above the midpoint of the lever for manual manipulation producing linear movement of said solenoid armature against the resistance of said spring loading;

(b) rotating joints connected moveably on one end of said levers to a midpoint of each lever and fixably mounted onto said base on the other end allowing said lever to pivot pulling or pushing said armatures in a linear direction simultaneously with the movement of the lever;

(c) a single swivel arm rotatably attached to said base having one end joined to the first of the levers providing a linkage reversing the rotational direction of the lever; and, (d) a connecting arm joined on swivel arm on an end opposite the first lever attachment and on the other end directly to a second lever at a position lower than said midpoint defining an intercommunication between levers allowing either lever to manually pull away from said solenoid disengaging both armatures simultaneously from the mechanical locking position with said arms for escapement or simultaneously engaging both arms for containment allowing both solenoids to be manually overridden in either mode of operation and to act as a single operating station.

* * * * *